US012678651B2

(12) United States Patent
Jiang et al.

(10) Patent No.: US 12,678,651 B2
(45) Date of Patent: Jul. 14, 2026

(54) ROTARY POSITIONING DUMBBELL COMBINATION STRUCTURE AND DUMBBELL

(71) Applicant: Xinjiashang (Dezhou) Fitness Technology Co., Ltd., Dezhou City (CN)

(72) Inventors: Chun Jiang, Dezhou City (CN); Shangwei Chen, Dezhou City (CN); Yong Jiang, Dezhou City (CN)

(73) Assignee: Xinjiashang (Dezhou) Fitness Technology Co., Ltd., Dezhou City (CN)

( * ) Notice: Subject to any disclaimer, the term of this patent is extended or adjusted under 35 U.S.C. 154(b) by 119 days.

(21) Appl. No.: 18/768,227

(22) Filed: Jul. 10, 2024

(65) Prior Publication Data

US 2025/0375652 A1 Dec. 11, 2025

(30) Foreign Application Priority Data

Jun. 11, 2024 (CN) ..... 202421317409.1

(51) Int. Cl.
*A63B 21/075* (2006.01)
*A63B 21/00* (2006.01)
*A63B 21/072* (2006.01)

(52) U.S. Cl.
CPC ..... *A63B 21/0726* (2013.01); *A63B 21/0728* (2013.01); *A63B 21/075* (2013.01); *A63B 21/4049* (2015.10)

(58) Field of Classification Search
CPC ..... A63B 21/0726; A63B 21/0728; A63B 21/075
See application file for complete search history.

(56) References Cited

U.S. PATENT DOCUMENTS 5,407,413 A * 4/1995 Kupferman ..... A63B 21/0728 482/106
8,790,223 B2 * 7/2014 Wang ..... A63B 21/075 482/106
12,246,208 B2 * 3/2025 McCoy ..... A63B 21/0726
(Continued)

FOREIGN PATENT DOCUMENTS

CN 216824658 U * 6/2022
CN 117282073 A * 12/2023 ..... A63B 21/075
(Continued)

*Primary Examiner* — Joshua T Kennedy
(74) *Attorney, Agent, or Firm* — Hawaii Patent Services; Nathaniel K. Fedde; Kenton N. Fedde

(57) ABSTRACT

A rotary positioning dumbbell combination structure and a dumbbell adopting the combination structure, and the rotary positioning dumbbell combination structure comprises at least one dumbbell plate body, and at least one of at least one radial protrusion or at least one radial groove is arranged on left and right sides of the at least one dumbbell plate body; at least one radial groove and at least one radial protrusion are matched; the at least one positioning protrusion is provided in the at least one radial groove; at least one radial elastic sheet is provided on the at least one radial protrusion; and the at least one positioning groove is provided on the at least one radial elastic sheet at a position facing the at least one positioning protrusion.

7 Claims, 2 Drawing Sheets

(56) References Cited

U.S. PATENT DOCUMENTS

| | | | | |
|---|---|---|---|---|
| 2003/0125169 | A1* | 7/2003 | Burwell | A63B 21/075 482/106 |
| 2023/0173327 | A1* | 6/2023 | Wang | A63B 21/075 482/107 |
| 2025/0010121 | A1* | 1/2025 | Jiang | A63B 21/075 |

FOREIGN PATENT DOCUMENTS

| | | | | |
|---|---|---|---|---|
| DE | 202024102726 | U1 * | 6/2024 | A63B 21/0728 |
| GB | 2610854 | A * | 3/2023 | A63B 21/075 |

* cited by examiner

ROTARY POSITIONING DUMBBELL COMBINATION STRUCTURE AND DUMBBELL

CROSS REFERENCE TO RELATED APPLICATION

This application claims the benefit of and takes priority from Chinese Patent Application No. 2024213174091 filed on Jun. 11, 2024, the contents of which are herein incorporated by reference.

TECHNICAL FIELD

The present invention belongs to the technical field of sports equipment, in particular to a rotary positioning dumbbell combination structure and a dumbbell.

BACKGROUND

Dumbbell is a conventional equipment used for arm strength training. In the process of use, in order to realize weight adjustment of the dumbbell, a common way at present is to add or subtract dumbbell plates by inserting or screwing.

There are some disadvantages when users add or subtract dumbbell plates by means of thread: operation efficiency is low, and the dumbbell plates after screwing are easy to loosen when they are used continuously or shaken, which has potential safety hazards, and the loosened dumbbell plates will shake as a whole, affecting use experience.

Please refer to the product structure disclosed in the Chinese utility model patent with the patent number of 2022205212694, wherein users add or subtract dumbbell plates by inserting; the disadvantages of the structure are as follows: the inserting structure and the switch structure are easy to loosen, which will lead to a safety problem of loosening of dumbbell plates; in April 2024, the applicant of the present invention applied for a dumbbell plate fixing method combining rotating clamping and top locking; in this structure, when adding or subtracting dumbbell plates, twisting action must be combined with horizontal switch driving action, which is relatively cumbersome to operate and still has room for improvement.

According to the feedback from consumers, technical developers in the field need to improve the locking structure of dumbbell plates on the basis of the existing rotatable dumbbell plates, with the aim of removing the horizontal locking structure and positioning directly through the rotating structure of the dumbbell plates, so as to solve the new technical problems encountered in the prior art.

SUMMARY OF THE INVENTION

In order to overcome the shortcomings of the prior art, the present patent application discloses a rotary positioning dumbbell combination structure and a dumbbell, wherein dumbbell plates adopt an independent screw locking structure, and an elastic positioning part is arranged on the screw structure, and a purpose thereof is to improve operation convenience and use safety of the assembled dumbbell.

In order to achieve the technical purpose above, the present invention adopts following specific solutions: a rotary positioning dumbbell combination structure, comprising at least one dumbbell plate body, and at least one of at least one radial protrusion or at least one radial groove is arranged on left and right sides of the at least one dumbbell plate body;

the at least one radial groove and the at least one radial protrusion are matched; at least two axial blocking plates at groove end are uniformly arranged on at least one outer end surface of the at least one radial groove; at least one internal insertion groove is arranged at inner sides of the axial blocking plates at groove end; two axial blocking plates at protrusion end are uniformly distributed on the at least one outer end surface of the at least one radial protrusion; and at least one external insertion groove is provided on inner sides of the axial blocking plates at protrusion end; and at least one positioning protrusion is provided in the at least one radial groove;

at least one radial elastic sheet is provided on the at least one radial protrusion; at least one positioning groove is provided on the at least one radial elastic sheet at a position facing the at least one positioning protrusion; and at least one first anti-dropping protrusion and at least one second anti-dropping protrusion are respectively provided on the left and right sides of the at least one positioning groove.

At least one fixing frame is provided in the at least one dumbbell plate body; at least one elastic component is radially fixed in the at least one fixing frame; and at least one end of the at least one elastic component contacts with the at least one radial elastic sheet and exerts force on the at least one radial elastic sheet.

The at least one radial elastic sheet is designed integrally with the at least one radial protrusion; at least one blocking part is provided on the at least one side panel provided with the at least one radial protrusion; and an outer side of the at least one radial elastic sheet is limited by the at least one blocking part;

At least one positioning gap is arranged between the at least one positioning protrusion and the axial blocking plates at groove end; and the at least one positioning gap is clamped and matched with the at least one first anti-dropping protrusion at an edge of the at least one positioning groove.

at least one inner radial blocking plate is arranged at at least one end of the at least one internal insertion groove;

at least one outer radial blocking plate is provided on at at least one end of the at least one external insertion groove, A dumbbell, comprising a handle 9, wherein a plurality of dumbbell plate bodies are symmetrically fixed on both sides of the handle; at least one of at least one radial protrusion or at least one radial groove is arranged on an outer side surface of each of inner dumbbell plate bodies directly fixed with the handle; and at least one of at least one radial protrusion or at least one radial groove is provided on an inner side surface of each of end dumbbell plate bodies; the outer side surfaces of the inner dumbbell plate bodies are matched with the inner side surfaces of the end dumbbell plate bodies; and the at least one radial protrusion and the at least one radial groove are respectively arranged on left and right sides of each of several middle dumbbell plate bodies located between the inner dumbbell plate bodies and the end dumbbell plate bodies.

At least one screwing mark is provided in the at least one radial groove, and the present invention guides users to screw and lock the dumbbell plate bodies through the screwing mark.

The present invention has following beneficial effects: the present invention discloses a rotary positioning dumbbell combination structure and a dumbbell adopting the combination structure, and the rotary positioning dumbbell combination structure comprises at least one dumbbell plate body, and at least one of the at least one radial protrusion or the at least one radial groove is arranged on left and right sides of the at least one dumbbell plate body; the at least one radial groove and the at least one radial protrusion are matched; the at least one positioning protrusion is provided in the at least one radial groove; the at least one radial elastic sheet is provided on the at least one radial protrusion; and the at least one positioning groove is provided on the at least one radial elastic sheet at a position facing the at least one positioning protrusion. Through the above structure, when the at least one radial protrusion and the at least one radial groove are screwed together, the at least one positioning protrusion can squeeze the at least one radial elastic sheet to deform, and under action of elastic force, the at least one positioning groove is inserted and matched with the at least one positioning protrusion to realize locking and positioning; and the locking realized through the structure above can prevent the dumbbell plate bodies after screwed from loosening when there is no external force.

In the present invention, the locking and positioning structure is arranged in the at least one radial protrusion and the at least one radial groove. When used on the dumbbell, the positioning and locking are realized when two adjacent dumbbell plate bodies are combined by screwing; as there is no need to arrange locking mechanism outside the dumbbell plate bodies, operation is more convenient than when using the existing structure in the prior art.

Figure 1:
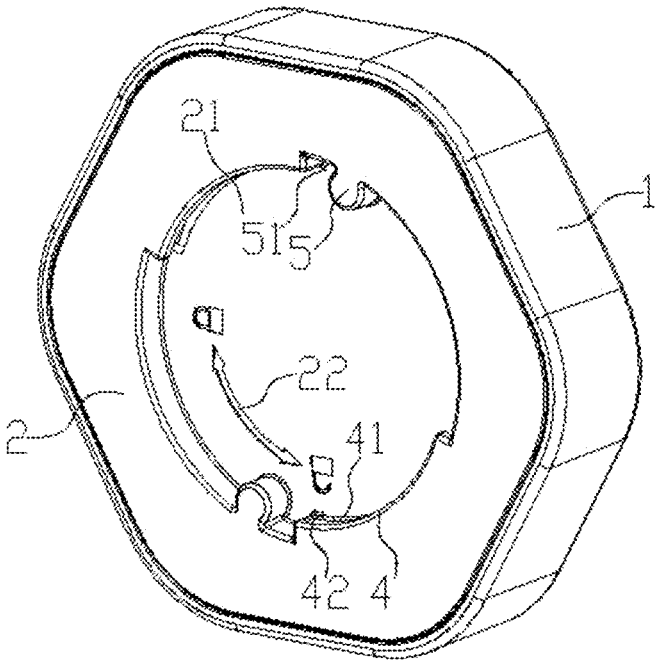
FIG. 1 is a schematic diagram of an internal structure of a radial groove on a dumbbell plate body.

In the drawings: 1. dumbbell plate body, 11. fastening protrusion, 12. blocking part, 13. middle dumbbell plate body, 14. inner dumbbell plate body, 15. end dumbbell plate body, 2. first side panel, 21. radial groove, 22. screwing mark, 23. fastening groove, 3. second side panel, 31. radial protrusion, 4. axial blocking plate at groove end, 41. internal insertion groove, 42. inner radial blocking plate, 5. positioning protrusion, 51. positioning gap, 6. axial blocking plate at protrusion end, 61. outer insertion groove, 62. outer radial blocking plate, 7. radial elastic sheet, 71. positioning groove, 72. first anti-dropping protrusion, 73. second anti-dropping protrusion, 74. force application surface, 8. fixing frame, 81. spring fixing bin, 82. spring, and 9. handle.

DETAILED DESCRIPTION OF THE EMBODIMENTS

The present invention will be described in detail through specific embodiments below, but it should be pointed out that the following specific embodiments do not technically limit the present technical solutions, and those skilled in the art can make further technical extension under guidance of the following technical solutions.

It should be noted that in the description of the embodiments of the present invention, the azimuth or positional relationship indicated by the terms "radial", "axial", "left", "right", "inside" and "outside" is based on the azimuth or positional relationship shown in the attached drawings, only for the convenience of describing the embodiments of the present invention and simplifying the description, and does not indicate or imply that the devices referred to must have a specific orientation, be constructed and operated in a specific orientation. In addition, the terms "first" and "second" are only used to rank the number of parts, and cannot be understood as indicating or implying relative importance.

Embodiment 1

Figure 2:
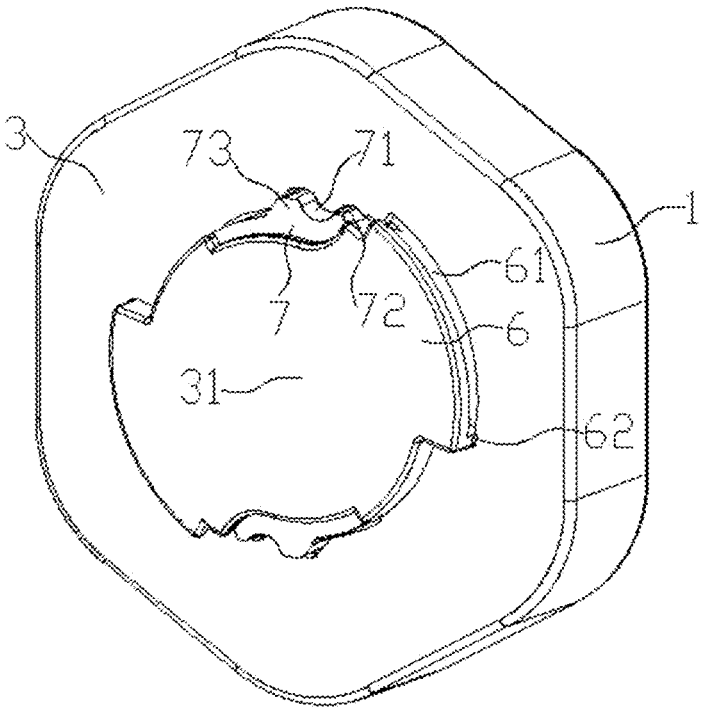
FIG. 2 is a schematic diagram of an internal structure of a radial protrusion on the dumbbell plate body.
Figure 3:
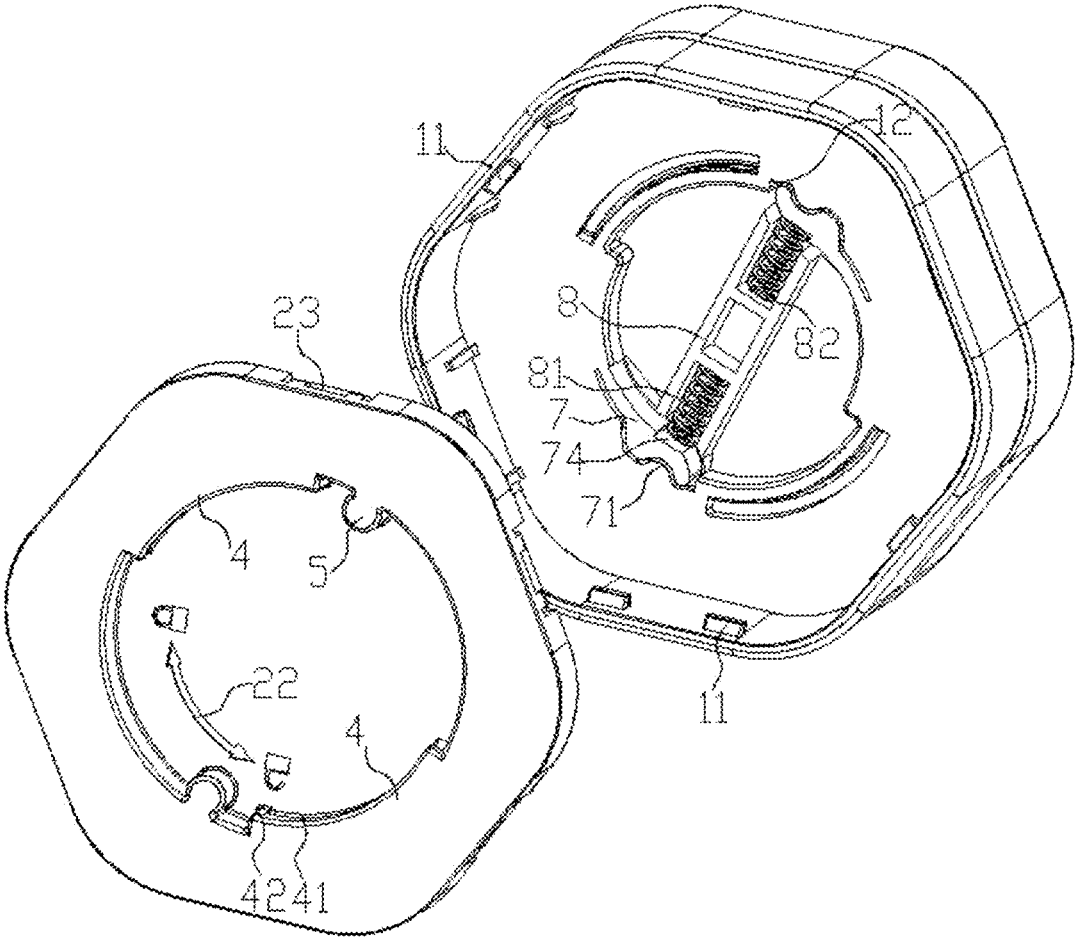
FIG. 3 is a schematic diagram of a driving structure when a radial elastic sheet is reset.

A rotary positioning dumbbell combination structure, as shown in FIGS. 1, 2 and 3, comprises at least one dumbbell plate body 1, and at least one of at least one radial protrusion 31 or at least one radial groove 21 is arranged on left and right sides of the at least one dumbbell plate body 1; the at least one radial groove 21 and the at least one radial protrusion 31 are matched.

Figure 4:
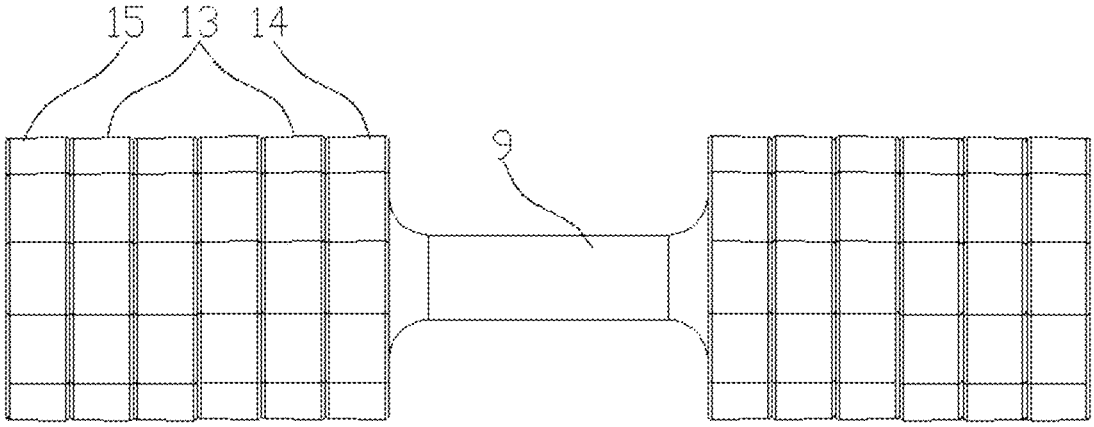
FIG. 4 is a schematic diagram of a combination structure of the dumbbell.

In practical use, like the dumbbell in FIG. 4, only one of the at least one radial protrusion 31 or the at least one radial groove 21 is provided on each of two inner dumbbell plate bodies 14 arranged on left and right sides of a handle 9; only one of the at least one radial protrusion 31 or the at least one radial groove 21 is provided on each of two dumbbell plate bodies 15 arranged on at two ends of the dumbbell; and on each of several middle dumbbell plate bodies 13, the at least one radial protrusion 31 and the at least one radial groove 21 are respectively arranged on left and right sides.

At least one first side panel 2 and at least one second side panel 3 are respectively provided on two side surfaces of the at least one dumbbell plate body 1; as shown in FIG. 3, at least one fastening groove 23 is provided on outer diameters of the at least one first side panel 2 and the at least one second side panel 3, and a plurality of fastening protrusions 11 are correspondingly arranged on the at least one dumbbell plate body 1, so that the at least one fastening groove 23 is butted and combined with a plurality of fastening protrusions 11.

In the embodiment 1, at least one radial groove 21 is arranged at at least one axial center of the at least one first side panel 2; as shown in FIGS. 1 and 3, two axial blocking plates at groove end 4 are uniformly arranged on at least one outer end surface of the at least one radial groove 21; at least one internal insertion groove 41 is arranged at inner sides of the axial blocking plates at groove end 4; at least one inner radial blocking plate 42 is arranged at at least one end of the at least one internal insertion groove 41; in the structure, at least one internal insertion groove 41 with a single end opening can be formed at inner sides of the axial blocking plates at groove end 4; and when the at least one radial groove 21 and the at least one radial protrusion 31 are screwed and locked, and the at least one radial groove 21 and the at least one radial protrusion 31 will not be loosened after screwed.

As shown in FIGS. 2 and 3, corresponding to the at least one radial groove 21, two axial blocking plates at protrusion end 6 are uniformly distributed on the at least one outer end surface of the at least one radial protrusion 31; at least one external insertion groove 61 is provided on inner sides of the axial blocking plates at protrusion end 6; and at least one outer radial blocking plate 62 is provided on at at least one end of the at least one external insertion groove 61, which has a same function as the at least one inner radial blocking plate 42.

The present invention also has following improvements: as shown in FIG. 1, at least one positioning protrusion 5 is provided in the at least one radial groove 21; at least one radial elastic sheet 7 is provided on a periphery of the at least one radial protrusion 31; at least one positioning groove 71 is provided on the at least one radial elastic sheet 7 at a position facing the at least one positioning protrusion; the at least one positioning protrusion 5 is matched with the at least one positioning groove 71 to be fixed, and a radial elastic force on the at least one radial elastic sheet 7 needs to be overcome during engaging and disengaging.

In the present embodiment, in order to ensure that the at least one positioning protrusion 5 and the at least one positioning groove 71 are clamped smoothly, the at least one positioning protrusion 5 adopts a cylindrical structure, and the at least one positioning groove 71 is arranged in an arc shape, and at least one first anti-dropping protrusion 72 and at least one second anti-dropping protrusion 73 are respectively provided on the left and right sides of the at least one positioning groove 71.

When two adjacent dumbbell plate bodies 1 are assembled, the at least one radial groove 21 and the at least one radial protrusion 31 on adjacent dumbbell plates 3 are coaxially corresponding and staggered to realize an axial insertion; the axial blocking plates at groove end 4 are screwed into the at least one external insertion groove 61; axial blocking plates at protrusion end 6 are screwed into the at least one internal insertion groove 41 synchronously; so that the two adjacent dumbbell plate bodies 1 are combined when the at least one inner radial blocking plate 42 and the at least one outer radial blocking plate 62 are squeezed into a whole; during the process, the at least one positioning protrusion 5 and the at least one positioning groove 71 are clamped synchronously to realize positioning and locking; the at least one positioning protrusion 5 squeezes the first anti-dropping protrusion 72 to offset the elastic force of the at least one radial elastic sheet 7 and then falls into the at least one positioning groove 71; when separating, the at least one positioning protrusion 5 squeezes the at least one first anti-dropping protrusion 72 to offset the elastic force of the at least one radial elastic sheet 7 and then slides out of the at least one positioning groove 71.

The present structure is more stable than a insertion structure in the prior art, and at the same time, an axial switch on an outer diameter can be removed, and the dumbbell bodies can be assembled through the combination of the at least one radial groove 21 and the at least one radial protrusion 31, and locked through the clamping of the at least one positioning groove 71 and the at least one positioning protrusion 5.

On the basis of the above structure, further, the structure of the axial blocking plates at groove end 4 and the axial blocking plates at protrusion end 6 is designed as a structure with gradual thickness, namely, the blocking plate bodies are gradually thickened from radial ends to the radial insides; the blocking plate bodies proposed here refers to the axial blocking plates at groove end 4 and the axial blocking plates at protrusion end 6 themselves; through the above structure, the axial blocking plates at groove end 4 and the axial blocking plates at protrusion end 6 can be tightened gradually when they are screwed, further promoting the combination of the two adjacent dumbbell plate bodies 1.

In the present embodiment, the at least one radial elastic sheet 7 has a certain restoring elasticity; when arranged, the at least one radial elastic sheet 7 is designed integrally with the at least one radial protrusion 31; at least one blocking part 12 is provided on the at least one second side panel 3 provided with the at least one radial protrusion 31, and an outer side of the at least one radial elastic sheet 7 is limited by the at least one blocking part 12; at least one fixing frame 8 is provided in the at least one dumbbell plate body 1; at least one spring fixing bin 81 is radially arranged in the at least one fixing frame 8; at least one spring 82 is fixed in the at least one spring fixing bin 81; and at least one force application surface 74 is provided on the at least one radial elastic sheet 7 and in pressing contact with an end of the at least one spring 82.

At least one positioning gap 51 is arranged between the at least one radial elastic sheet 7 and the axial blocking plates at groove end 4; and the at least one positioning gap 51 is inserted and matched with the at least one first anti-dropping protrusion 72 at an edge of the at least one positioning groove 71.

Embodiment 2

A dumbbell, which adopts the rotary positioning dumbbell combination structure as described above.

As shown in FIG. 4, the dumbbell comprises a handle 9, a plurality of dumbbell plate bodies 1 are symmetrically fixed on both sides of the handle 9; the at least one radial groove 21 is arranged on an outer side of each of inner dumbbell plate bodies 14 directly fixed with the handle; and at least one radial protrusion 31 is provided on an inner side of each of end dumbbell plate bodies 15;

the at least one radial protrusion 31 and the at least one radial groove 21 are respectively arranged on left and right sides of each of several middle dumbbell plate bodies 13 located between the inner dumbbell plate bodies 14 and the end dumbbell plate bodies 15.

At least one screwing mark 22 is provided in the at least one radial groove 21, and the present invention guides users to screw and lock the dumbbell plate bodies through the screwing mark 22.

It is easier for those skilled in the art to observe and clearly define the screwing direction according to the at least one screwing mark 22, which further guides the users to assemble a plurality of dumbbell plate bodies 1.

What is claimed is:

1. A rotary positioning dumbbell combination structure, comprising at least one dumbbell plate body, including at least one radial protrusion located on a first side of the plate body and at least one radial groove located on a second, opposing side of the plate body;

an inner periphery of the at least one radial groove and an outer periphery of the at least one radial protrusion are defined in terms of blocking plates and corresponding insertion grooves; at least two axial blocking plates at the second side of the plate body are uniformly arranged on at least one outer end surface of the at least one radial groove; at least one internal insertion groove is arranged at inner sides of the axial blocking plates at the second side of the plate body; at least two axial blocking plates at the first side of the plate body are uniformly distributed on the at least one outer end surface of the at least one radial protrusion; and at least one external insertion groove is provided on inner sides of the axial blocking plates at the first side of the plate body; and at least one positioning protrusion is provided in the at least one radial groove; at least one radial elastic sheet is provided on the at least one radial protrusion; at least one positioning groove is provided on the at least one radial elastic sheet at a position opposite to the at least one positioning protrusion; and at least one first anti-dropping protrusion and at least one second anti-dropping protrusion are respectively provided on the left and right sides of the at least one positioning groove.

2. The rotary positioning dumbbell combination structure according to claim 1, wherein at least one fixing frame is provided in the at least one dumbbell plate body; at least one elastic component is radially fixed in the at least one fixing frame; and at least one end of the at least one elastic component contacts with the at least one radial elastic sheet and exerts force on the at least one radial elastic sheet.

3. The rotary positioning dumbbell combination structure according to claim 1, wherein the at least one radial elastic sheet is designed integrally with the at least one radial protrusion; at least one blocking part is provided on at least one side panel provided with the at least one radial protrusion; and an outer side of the at least one radial elastic sheet is limited by the at least one blocking part.

4. The rotary positioning dumbbell combination structure according to claim 1, wherein at least one positioning gap is arranged between the at least one positioning protrusion and the axial blocking plates at the second side of the plate body; and the at least one positioning gap is filled by the at least one first anti-dropping protrusion at an edge of the at least one positioning groove.

5. The rotary positioning dumbbell combination structure according to claim 1, wherein the axial blocking plate of the radial groove is arranged at at least one end of the at least one internal insertion groove.

6. The rotary positioning dumbbell combination structure according to claim 1, wherein the axial blocking plate of the protrusion is provided on at least one end of the at least one external insertion groove.

7. A dumbbell, wherein joints between middle dumbbell plate bodies, inner dumbbell plate bodies and end dumbbell plate bodies adopt the rotary positioning dumbbell combination structure according to claim 1.

* * * * *